US006361372B1

(12) United States Patent
Chiang

(10) Patent No.: US 6,361,372 B1
(45) Date of Patent: Mar. 26, 2002

(54) MOBILE BACKUP KIT ASSEMBLY

(76) Inventor: Thomas Shiaw-Cherng Chiang, No. 67, Chung-Yang 2nd Street, Chung-Yang Hsinchun, Hsintien, Taipei (TW)

( * ) Notice: Subject to any disclaimer, the term of this patent is extended or adjusted under 35 U.S.C. 154(b) by 0 days.

(21) Appl. No.: 09/736,458

(22) Filed: Dec. 15, 2000

(51) Int. Cl.[7] ..... H01R 13/64
(52) U.S. Cl. ..... 439/680
(58) Field of Search ..... 439/502, 638, 439/655, 680; 361/784, 785; 174/117 F, 36

(56) References Cited

U.S. PATENT DOCUMENTS 5,239,445 A 8/1993 Parks et al. ..... 361/729
5,554,825 A * 9/1996 Parker et al. ..... 174/117 F
5,808,860 A * 9/1998 Ohgami et al. ..... 361/680
5,816,842 A * 10/1998 Thantrakul et al. ..... 439/374
5,855,064 A * 1/1999 Chang ..... 29/861
5,865,651 A 2/1999 Dague et al. ..... 439/680
5,877,865 A * 3/1999 Fukuta ..... 358/296
5,900,588 A * 5/1999 Springer et al. ..... 174/117 F
5,996,045 A 11/1999 Lee et al. ..... 711/112

* cited by examiner

*Primary Examiner*—Tulsidas Patel
(74) *Attorney, Agent, or Firm*—Tipton L. Randall

(57) ABSTRACT

The present invention is directed to a connector and an assembly for connecting a computer having an internal hard drive with an external device for fast transmission of signals between devices. The connector provides for coupling two ATA signal transfer lines via two sets of signal transfer receptacles, with each receptacle set contained in a female connector of one signal transfer line. The connector also couples two electrical power lines to provide electrical power from the computer to the external device. A bracket secured to the connector positions the connector in an aperture of the computer case.

10 Claims, 16 Drawing Sheets

MOBILE BACKUP KIT ASSEMBLY

CROSS-REFERENCE TO RELATED APPLICATIONS, IF ANY

Not applicable.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention.

The present invention relates to an assembly for connecting a computer, having an internal hard disk drive, with an external device, and more particularly, to an assembly for this purpose that allows extremely fast signal transfer rates between the computer and the external device.

2. Background Information.

With the recent introduction of the Ultra ATA/100 interface for hard disk drives, and the continuous introduction of faster and more powerful central processor units (CPUs), new personal computer (PC) systems are equipped with high storage capacity hard disk drives equipped with an Ultra ATA/100 or similar interface. This interface allows full utilization of the performance of the fast CPUs and the demands of large software programs. Consequently, numerous older hard disk drives of lesser storage capacity with an industry-standard ATA (Advanced Technology Attachment) task file interface (here in after called an ATA interface) are left unused where individuals have upgraded their computers or replaced an older computer with a new one.

These older hard disk drives represent an unused source of storage capacity. Connecting such an external hard disk drive or other device having an ATA interface to another computer with an ATA or similar interface can be effected through either a printer port or a USB port. However, signal transmission between the computer and the external hard drive is limited by the speed of the printer port or a USB port. Additionally, an external hard disk drive (HDD) drive box having a power supply is required to power the external hard disk drive. This adds to the cost of implementing use of an external HDD.

The present invention provides a unique, inexpensive solution to connecting an external hard disk drive, or other peripheral device having an ATA interface, to a computer with high-speed signal transfer between the computer and the external device.

SUMMARY OF THE INVENTION

The present invention is directed to a device and an assembly for connecting a computer, having an internal hard drive, with an external device for fast transmission of signal between devices. The present invention is exemplified in a number of implementations and applications, some of which are summarized below.

According to an example embodiment, the present invention includes a connector for coupling two ATA signal transfer lines via two sets of signal transfer receptacles, with each receptacle set contained in a female connector of one signal transfer line. The connector also couples two electrical power lines. The connector includes an elongated generally cubical body member of a first length, a first width, and a first height. The body member has first and second faces and a peripheral surface comprising discontinuously planar upper and base parts, and first and second end parts. A cutout section is present in each upper and base part, with each cutout section opening to opposite body member faces. A set of dual pin members, each with first and second ends, is mounted in and extends through the body member in a width-wise direction. A first end of each pin member is arrayed for insertion into one set of signal transfer receptacles of one signal transfer line female connector, and a second end of each pin member is arrayed for insertion into another set of signal transfer receptacles of another signal transfer line female connector. A set of open-ended pin-receptacle members is mounted in and extends through the body member in a width-wise direction. Each pin-receptacle member of the set is arrayed to receive through a first face of the body a respective set of correspondingly arrayed pins of an electrical power line male plug, and through a second face of the body a respective set of correspondingly arrayed receptacles of an electrical power line female plug.

In another example embodiment of the present invention, the above described connector, combined with two signal transfer lines and two power cords, produces a connector assembly for signal transfer and powering an external device by a computer. The assembly includes a first signal transfer line connected at a first end to the computer hard drive via the internal drive electronics (IDE) header mounted on the system board. The first signal transfer line has a female connector containing a set of signal transfer receptacles at a second end. A second signal transfer line connected at a first end to the external device also has a female connector containing a set of signal transfer receptacles at a second end. A first power cord connected at a first end to the computer power supply has an arrayed set of receptacles in a female plug at a second end. A second power cord connected at a first end to the external device has an arrayed set of pins in a male plug at a second end.

The assembly has a connector for coupling first and second signal transfer lines and first and second power cords. The connector includes an elongated generally cubical body member of a first length, a first width, and a first height, the body member having first and second faces and a peripheral surface with discontinuously planar upper and base parts, and first and second end parts. There is a cutout section in each upper and base part, with each cutout section opening to opposite body faces. A set of dual pin members, each with first and second ends, is mounted in and extends through the body member in a width-wise direction. The first end of each pin member is arrayed for insertion into one set of signal transfer receptacles of the first signal transfer line female connector and the second end of each pin member is arrayed for insertion into another set of signal transfer receptacles of the second signal transfer line female connector. A set of open-ended pin-receptacle members is mounted in and extends through the body member in a width-wise direction. Each pin-receptacle member of the set is arrayed to receive through a first face of the body member a respective set of correspondingly arrayed pins of the second end of the electrical power line male plug. Each pin-receptacle of the set also is arrayed to receive through a second face of the body member a respective set of correspondingly arrayed receptacles of the second end of the electrical power line female plug.

The above summary of the present invention is not intended to describe each illustrated embodiment or every implementation of the present invention. The figures and detailed description that follow more particularly exemplify these embodiments.

BRIEF DESCRIPTION OF THE DRAWING

The invention may be more completely understood in consideration of the following detailed description of various embodiments of the invention in connection with the accompanying drawings, in which.

Figure 1:
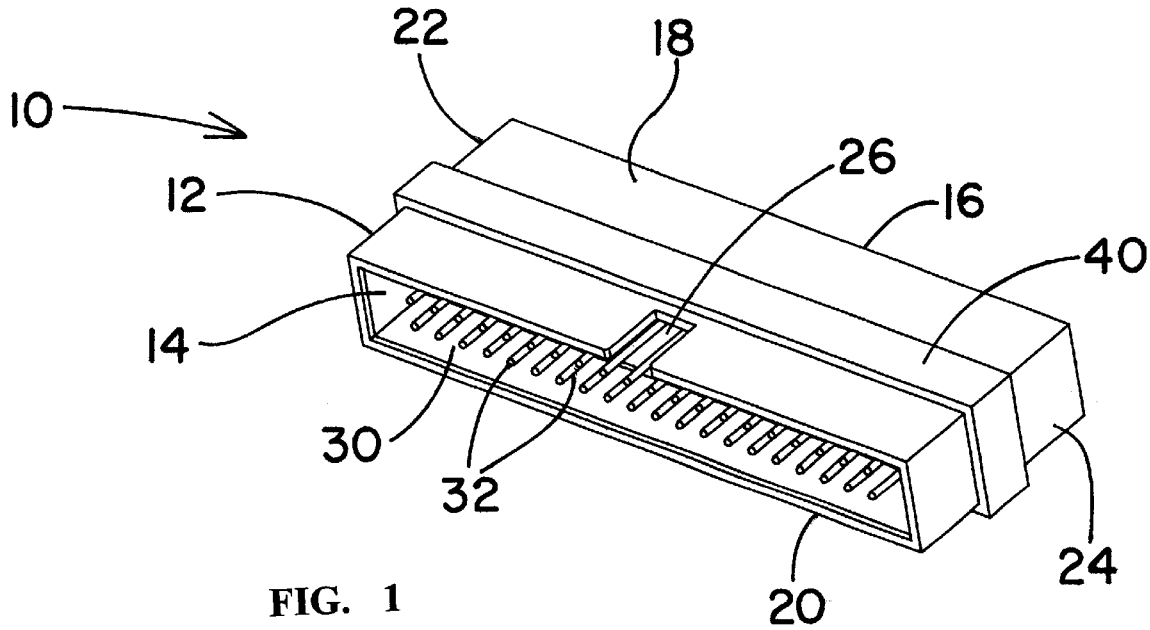
FIG. 1 illustrates a perspective view of a dual male connector, suitable for use in connection with an example embodiment of the present invention.

While the invention is amenable to various modifications and alternative forms, specifics thereof have been shown by way of example in the drawings and will be described in detail. It should be understood, however, that the intention is not necessarily to limit the invention to the particular embodiments described. On the contrary, the intention is to cover all modifications, equivalents, and alternatives falling within the spirit and scope of the invention as defined by the appended claims.

DESCRIPTION OF THE EMBODIMENTS

The present invention is believed to be applicable to the connection of a computer, having a hard disk drive, with an external hard disk drive or other external device having an ATA interface. While the present invention is not limited to connection of an external hard disk drive to a computer, an appreciation of various aspects of the invention is best gained through a discussion of various examples using this application.

According to a particular embodiment, the present invention includes a connector for coupling two ATA signal transfer lines via two sets of signal transfer receptacle, with each receptacle set contained in a female connector of one signal transfer line. The connector also couples two electrical power lines. The connector includes an elongated generally cubical body member of a first length, a first width, and a first height. The body member has first and second faces and a peripheral surface having discontinuously planar upper and base parts, and first and second end parts. A cutout section is present in each upper and base part, with each cutout section opening to opposite body member faces. A set of dual pin members, each with first and second ends, is mounted in and extends through the body member in a width-wise direction. A first end of each pin member is arrayed for insertion into one set of signal transfer receptacles of one signal transfer line female connector and a second end of each pin member is arrayed for insertion into another set of signal transfer receptacles of another signal transfer line female connector. A set of open-ended pin-receptacle members is mounted in and extends through the body member in a width-wise direction. Each pin-receptacle member of the set is arrayed to receive through a first face of the body a respective set of correspondingly arrayed pins of an electrical power line male plug, and through a second face of the body a respective set of correspondingly arrayed receptacles of an electrical power line female plug. The connector and associated signal transfer lines and power lines between a computer and an external hard disk drive or similar device allow extremely fast signal transfer rates between the internal hard disk drive and the external device.

Figure 2:
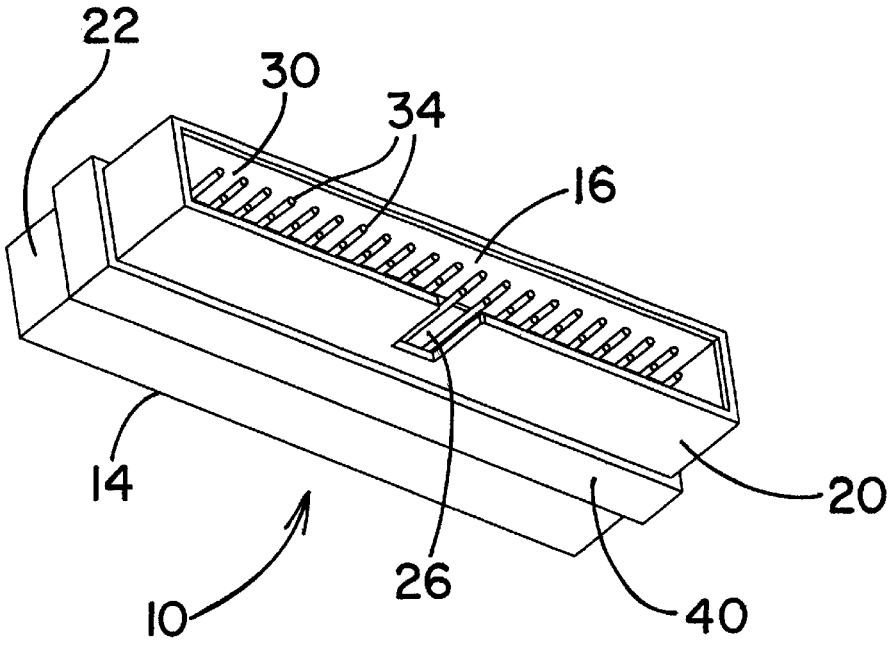
FIG. 2 illustrates another perspective view of a dual male connector, suitable for use in connection with another example embodiment of the present invention.

FIGS. 1 and 2 show perspective views of opposed faces of a dual male connector member 10 of one embodiment of the present invention. The connector member 10 couples two ATA signal transfer lines, one from a computer and another from a powered external device, such as a hard disk drive. The connector member 10 includes an elongated cubical body member 12 of a first length, a first width, and a first height. The body member 12 has first and second faces 14, 16 and a peripheral surface having a discontinuous planar upper part 18 and discontinuous base art 20, and first and second end parts 22, 24. The upper part 18 and base part 20 each contain a stout section 26 which opens to opposite body member faces 14, 16. The dual male connector member 10 contains a set of dual pin members 30, each pin member 30 with first and second ends 32, 34. The pin members 30 are mounted in and extend through the body member 12 in a width-wise direction. The set of dual pin members 30 preferably comprises forty pin members 30 arranged in an array of two rows of twenty pin members, with each row oriented parallel the body member length. The connector member 10 is fabricated from an insulative material while the dual pin members 30 are of a conducting material with each pin member electrically isolated from the other pin members of the set. The body member 12 also has an encircling collar member 40 secured about the peripheral surface of the body member 12.

Figure 3:
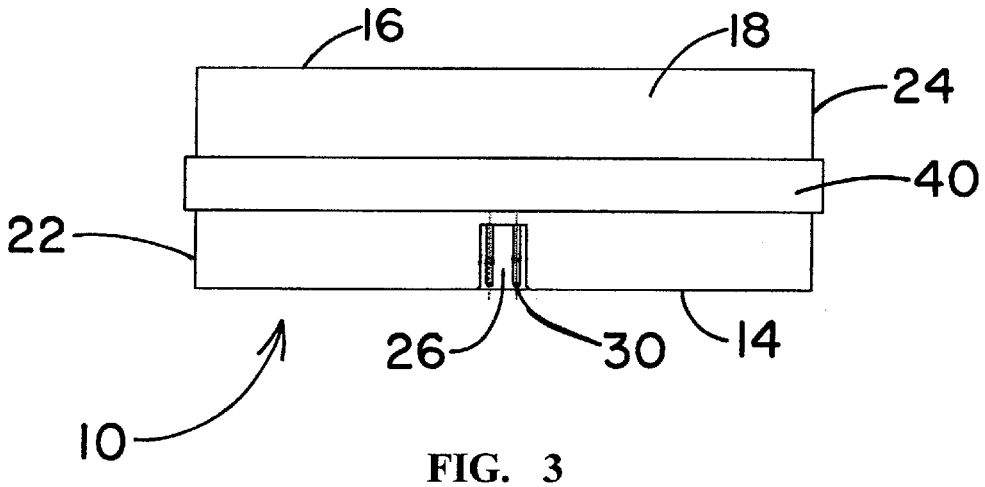
FIG. 3 illustrates a top view of a dual male connector, suitable for use in connection with another example embodiment of the present invention.
Figure 4:
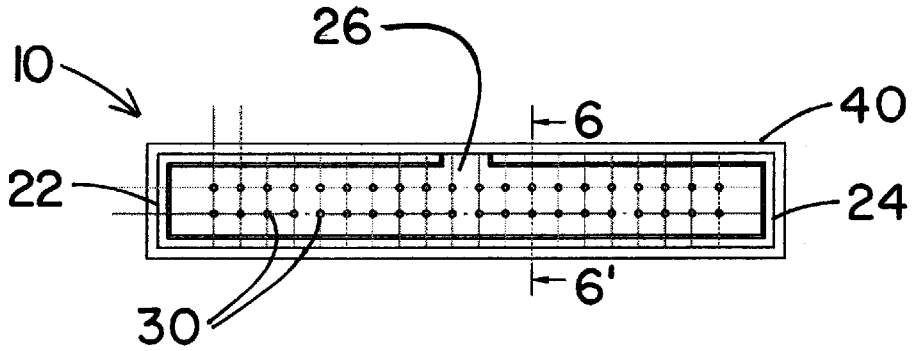
FIG. 4 illustrates a face view of a dual male connector, suitable for use in connection with another example embodiment of the present invention.
Figure 5:
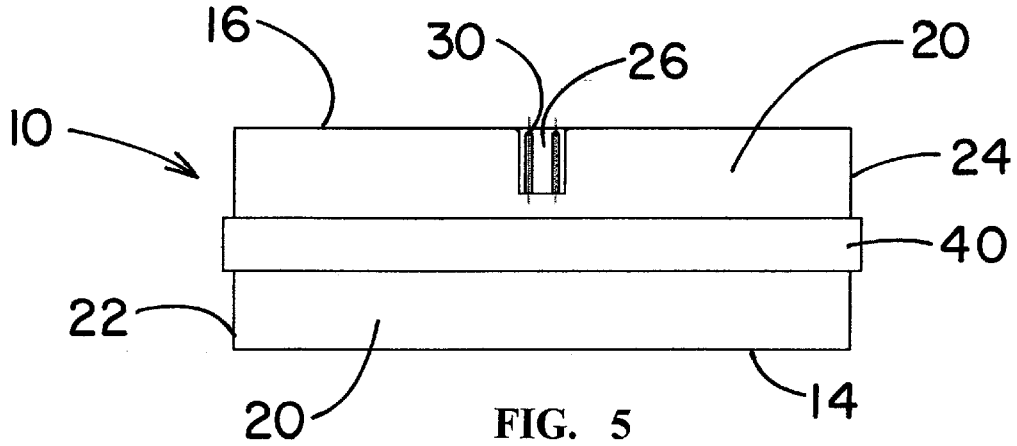
FIG. 5 illustrates a bottom view of a dual male connector, suitable for use in connection with another example embodiment of the present invention.
Figure 6:
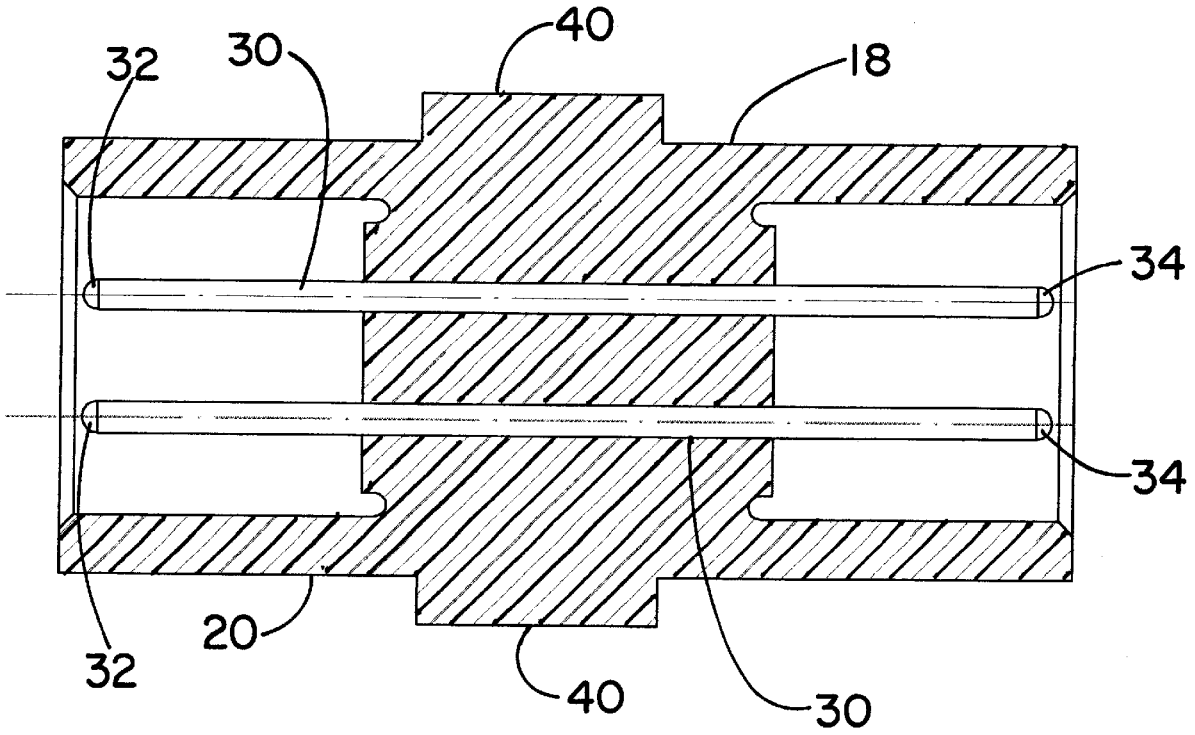
FIG. 6 illustrates an enlarged sectional view along line 6–6' of FIG. 4 of a dual male connector, suitable for use in connection with another example embodiment of the present invention.

FIGS. 3, 4, and 5 provide top, face and bottom views respectively, of the dual male connector 10. FIG. 6 is a sectional view along line 6–6' of FIG. 4. Each pin member 30 is straight and positioned to extend from the first face 14 to the second face 16 of the body member 12. The connector 10 is symmetrical with cut out sections 26 positioned diagonally on the body member 12 with one cut out opening on each body member face 14, 16. The cut out sections 26 are for positioning a signal transfer line female connector, having a set of signal transfer receptacles that accept one end of the set of dual pin members 30. The set of dual pin members 30 is arrayed to match the set of signal transfer receptacles of the female connector. The female connector also has a positioning member that fits into the cut out section 26.

Figure 7:
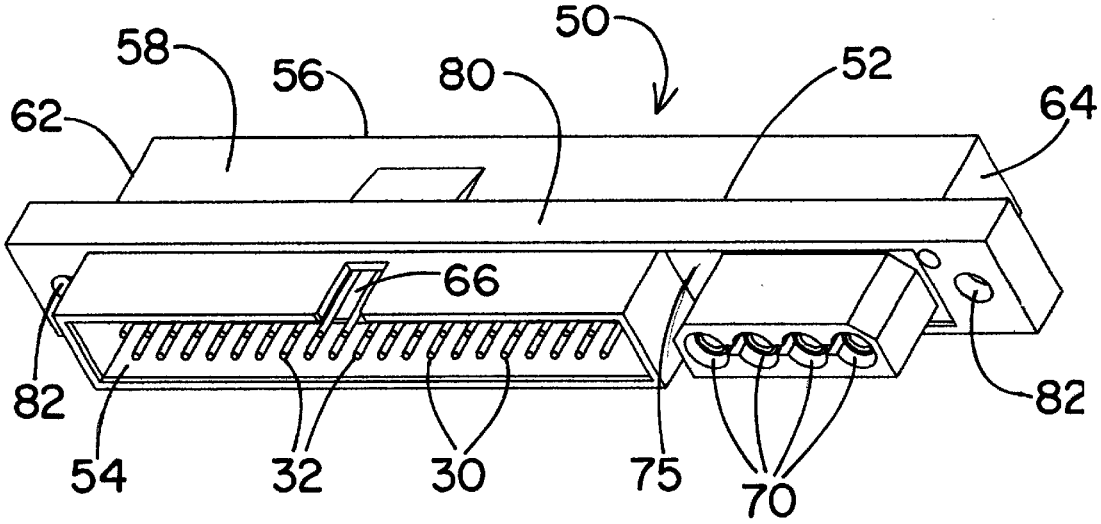
FIG. 7 illustrates a perspective view of a coupling connector, consistent with another example embodiment of the present invention.
Figure 8:
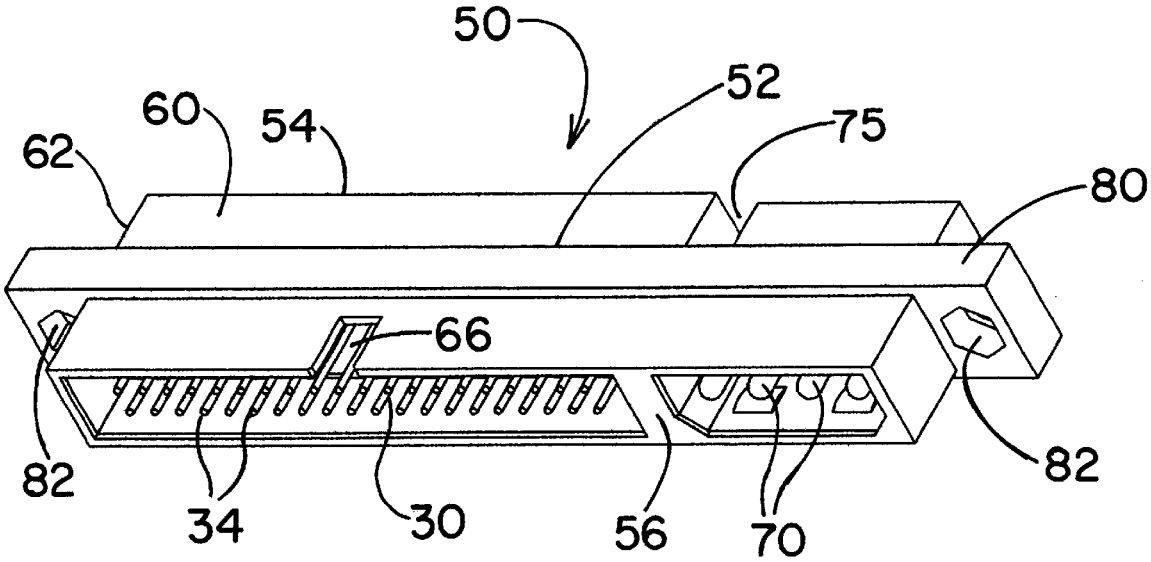
FIG. 8 illustrates another perspective view of a coupling connector, consistent with another example embodiment of the present invention.

FIGS. 7 and 8 show perspective views of opposing faces of a coupling connector member 50 of another embodiment of the present invention. The connector member 50 couples two ATA signal transfer lines, one from a computer and another from an external device, such as a hard disk drive, plus two electrical power lines, one from a computer and another from an external device, such as a hard disk drive. The connector member 50 includes an elongated cubical body member 52 of a first length, a first width, and a first height. The body member 52 has first and second faces 54, 56 and a peripheral surface having a discontinuous planar upper part 58 and discontinuous base part 60, and first and second end parts 62, 64. The upper part 58 and base part 60 each contain a cutout section 66 which opens to opposite body member faces 54, 56. The connector member 50 contains a set of dual pin members 30, each pin member 30 with first and second ends 32, 34. The pin members 30 are mounted in and extend through the body member 52 in a width-wise direction. The set of dual pin members 30 is arrayed to match a set of signal transfer receptacles of a female connector.

A set of open-ended pin-receptacle members 70 also is mounted in and extends through the body member 52 in a width-wise direction. Each pin-receptacle member 70 of the set has a receptacle end 72 and a pin end 74. The set of pin-receptacle members 70 is arrayed to receive through a first face 54 of the body member 52 a respective set of correspondingly arrayed pins of an electrical power line male plug. Each pin-receptacle member 70 of the set is also arrayed to receive through a second face 56 of the body member 52 a respective set of correspondingly arrayed receptacles of an electrical power line female plug. The body member first face 54 also includes a vertical channel 75 between the set of dual pin members 30 and the set of open-ended pin-receptacle members 70, allowing the channel 75 to accommodate the electrical power line male plug.

The set of dual pin members 30 preferably comprise forty pin members 30 arranged in an array of two rows of twenty pin members, with each row oriented parallel the body member length. The set of pin-receptacle members 70 preferably comprises four pin-receptacle members 70 arranged in an array of one row parallel the body member length and adjacent the set of dual pin members 30. The connector member 50 is fabricated from an insulative material while the dual pin members 30 and pin-receptacle members 70 are of a conducting material, with each pin member 30 and each pin-receptacle member 70 electrically isolated from the other members of the sets.

Figure 13:
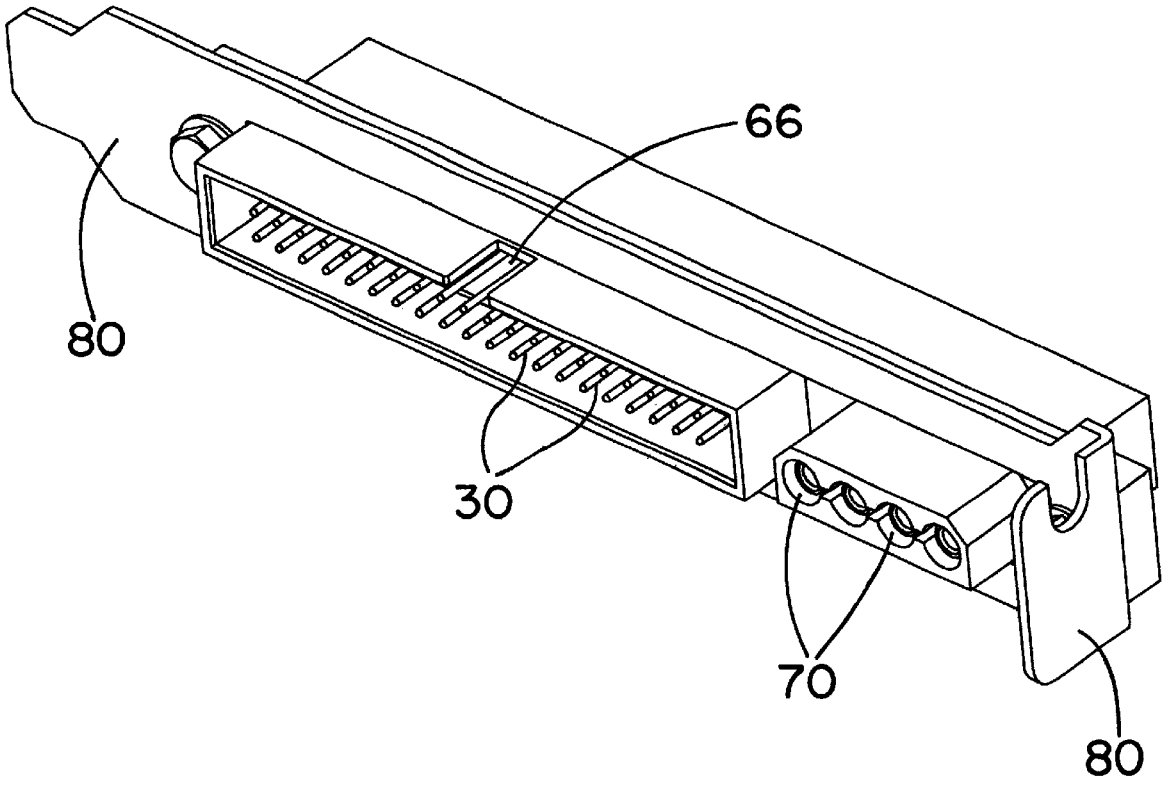
FIG. 13 illustrates a perspective view of a coupling connector, suitable for use in connection with another example embodiment of the present invention.

FIGS. 7–11 shows a further embodiment of the invention, wherein a bracket member 80 is secured to the connector body member 52 along the peripheral surface thereof The bracket member 80 fastened along the top and bottom length and side of the connector member body 52 includes a plurality of apertures 82 used to secure the bracket member 80 and connector member 50 in an electrical device case aperture, such as a computer case. FIG. 13 shows a bracket member 80 with an alternative configuration for securing the connector member 50 in an I/O slot of a computer case.

Figure 9:
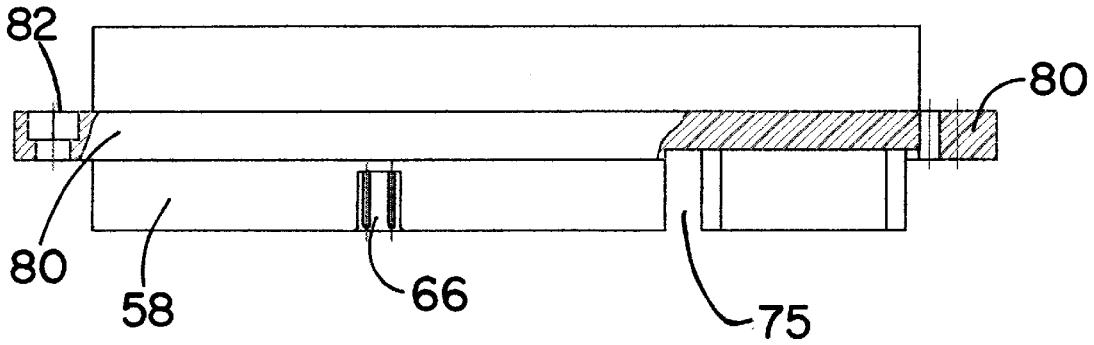
FIG. 9 illustrates a top view of a coupling connector, suitable for use in connection with another example embodiment of the present invention.
Figure 10:
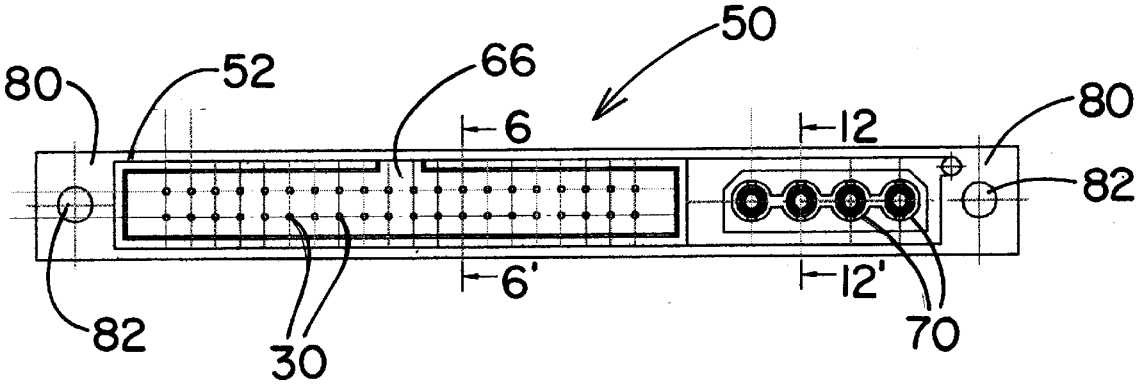
FIG. 10 illustrates a front view of a coupling connector, consistent with another example embodiment of the present invention.
Figure 11:
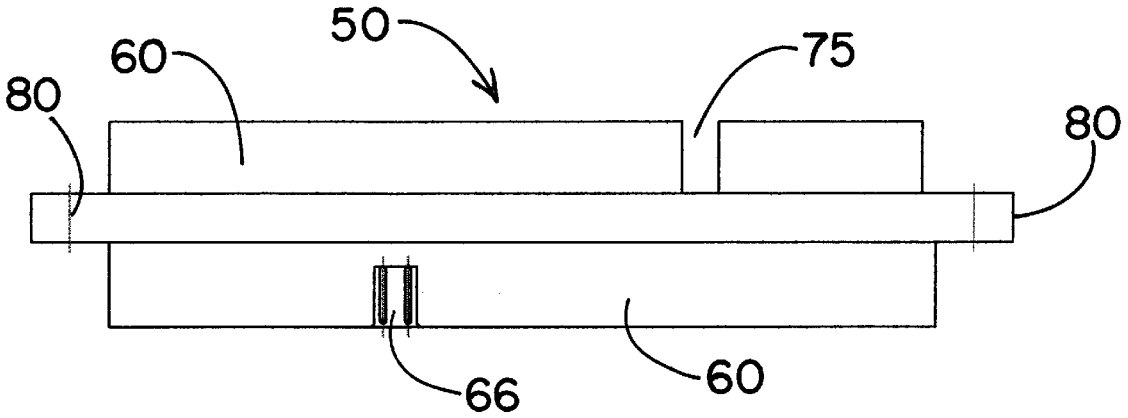
FIG. 11 illustrates a bottom view of a coupling connector, suitable for use in connection with another example embodiment of the present invention.
Figure 12:
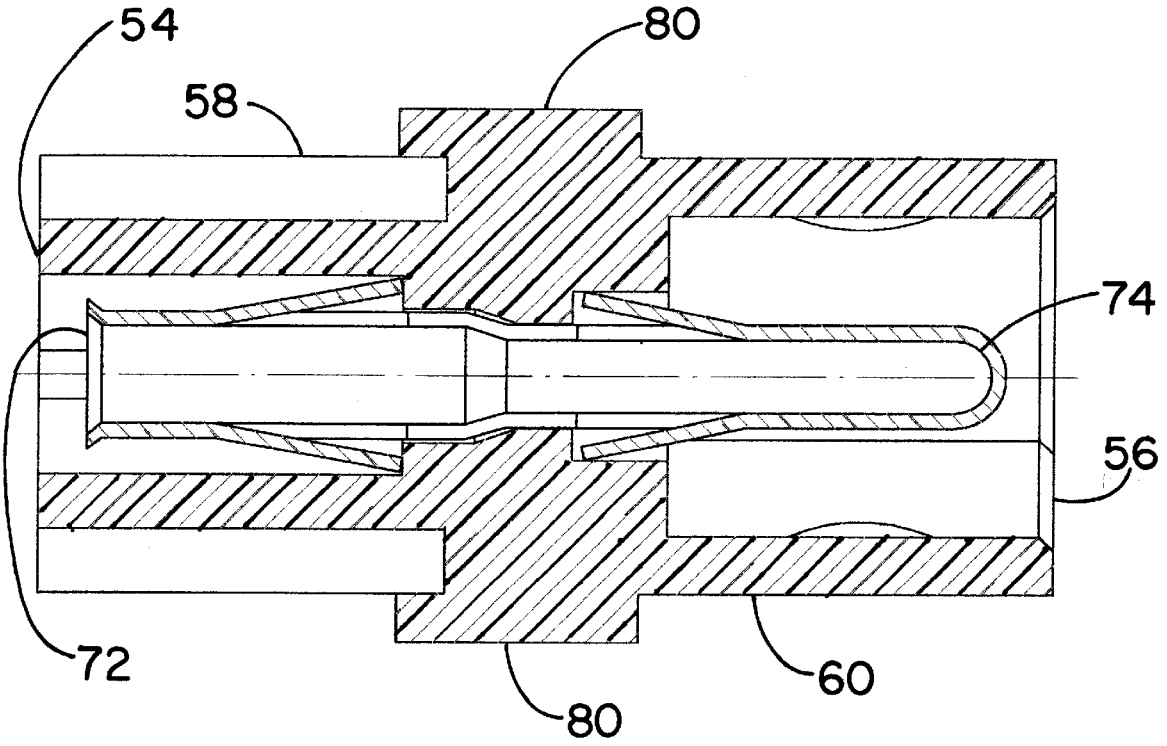
FIG. 12 illustrates an enlarged sectional view of a coupling connector along line 12–12' of FIG. 10, suitable for use in connection with another example embodiment of the present invention.

FIGS. 9, 10, and 11 provide top, face and bottom views respectively, of the coupling connector 50. FIG. 6 is a sectional view along line 6–6' of FIG. 10 and FIG. 12 is a sectional view along line 12–12' of FIG. 10. Each pin member 30 is straight and positioned to extend from the first face 54 to the second face 56 of the connector body member 52. Each pin-receptacle member 70 is also straight with a receptacle end 72 at the first face 54 of the body member 52 and a pin end 74 at the second face 56 of the body member 52.

Figure 14:
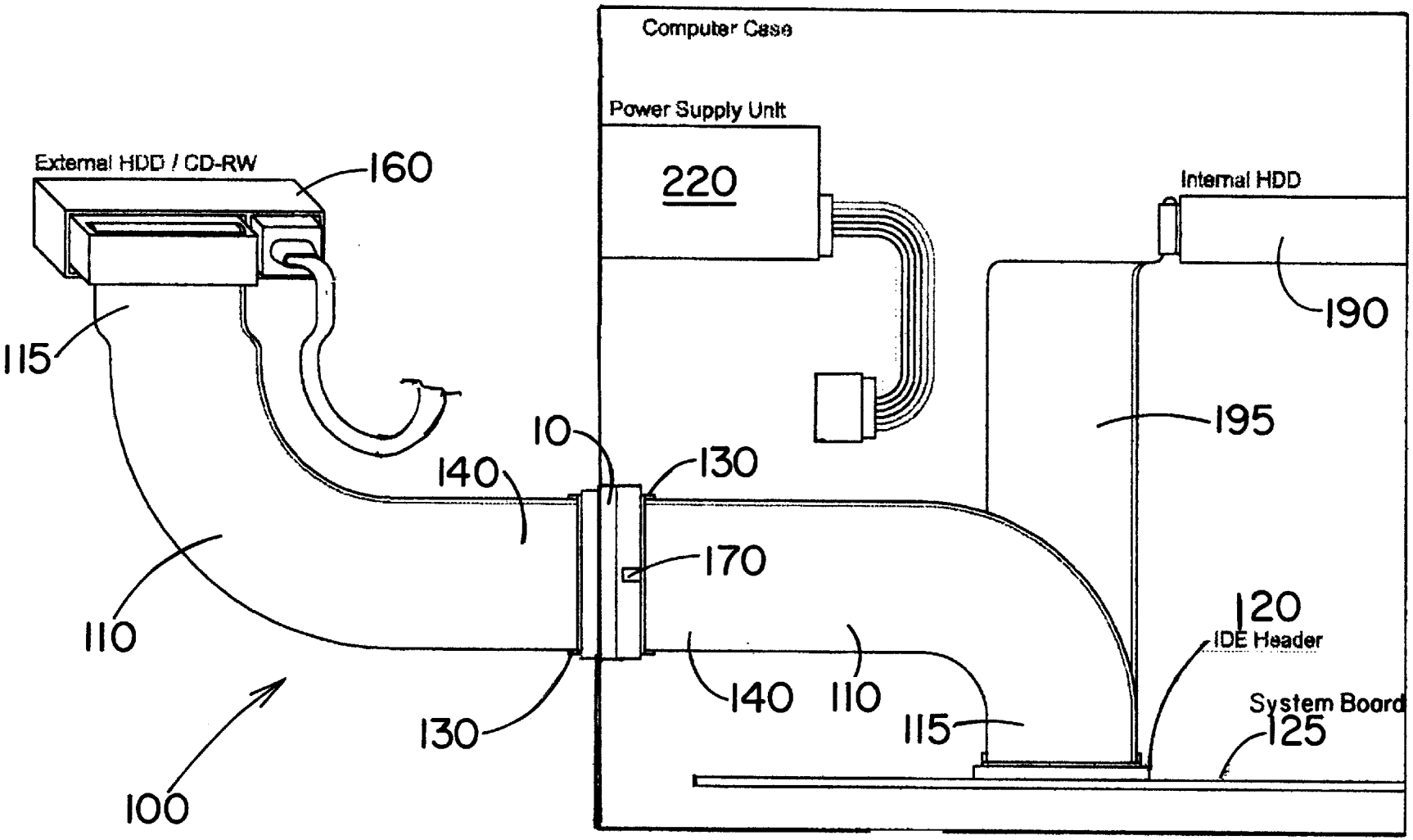
FIG. 14 illustrates a connecting assembly, suitable for use in connection with another example embodiment of the present invention.

In a further embodiment of the invention, an assembly 100 for connecting a computer, having a system board with an IDE header and a hard disk drive, with a powered external device for signal transfer is shown in FIG. 14. The assembly 100 includes a first signal transfer line 110 connected at a first end 115 to the computer via the IDE header 120 mounted on the system board 125 of the computer. The first signal transfer line 110 has a female connector 130 containing a set of signal transfer receptacles 135 (not shown) at a second end 140. A second signal transfer line 110, essentially the same as the first signal transfer line, is connected at a first end 115 to the powered external device 160, such as a hard disk drive. The second signal transfer line 110 has a female connector 130 containing a set of signal transfer receptacles 135 (not shown) at a second end 140. The first and second female connectors 130 each plug into one face of the dual male connector member 10, described above, for coupling the first and second signal transfer lines 110, as shown in FIG. 14. Each female connector 130 of the signal transfer lines 110 has a positioning member 170 that fits into one cutout slot 26 of the connector member 10. The connector member 10 is positioned in an aperture in a computer case to simplify connection of the two signal transfer lines 110 via the connector member 10. It should be noted that the computer internal hard disk drive 190 is also connected to the IDE header 120 of the system board 125 via a separate signal transfer line 195. Although the signal transfer lines 110 can be of any suitable structure, preferably the signal transfer lines 110 and 195 are flat, forty conductor ribbon cables as depicted in FIG. 14 and shown in greater detail in FIG. 16. Most preferably, the signal transfer lines 110 and 195 are flat, eighty conductor ribbon cables including forty ground conductors. The eighty conductor ribbon cables are suitable for meeting the older Ultra ATA/66 and new Ultra ATA/100 interface requirements.

Figure 16:
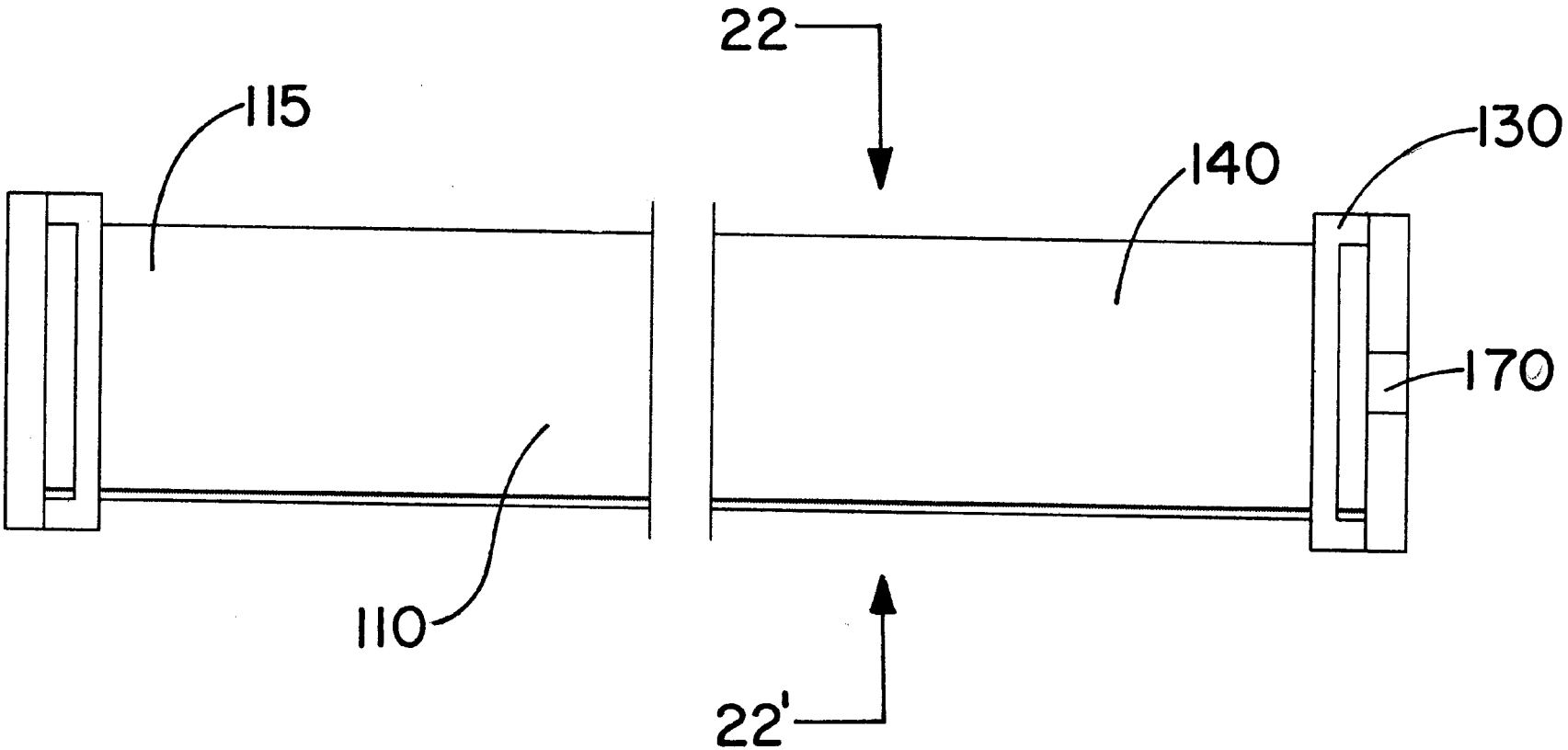
FIG. 16 illustrates a signal transfer line, suitable for use in connection with another example embodiment of the present invention.
Figure 22:
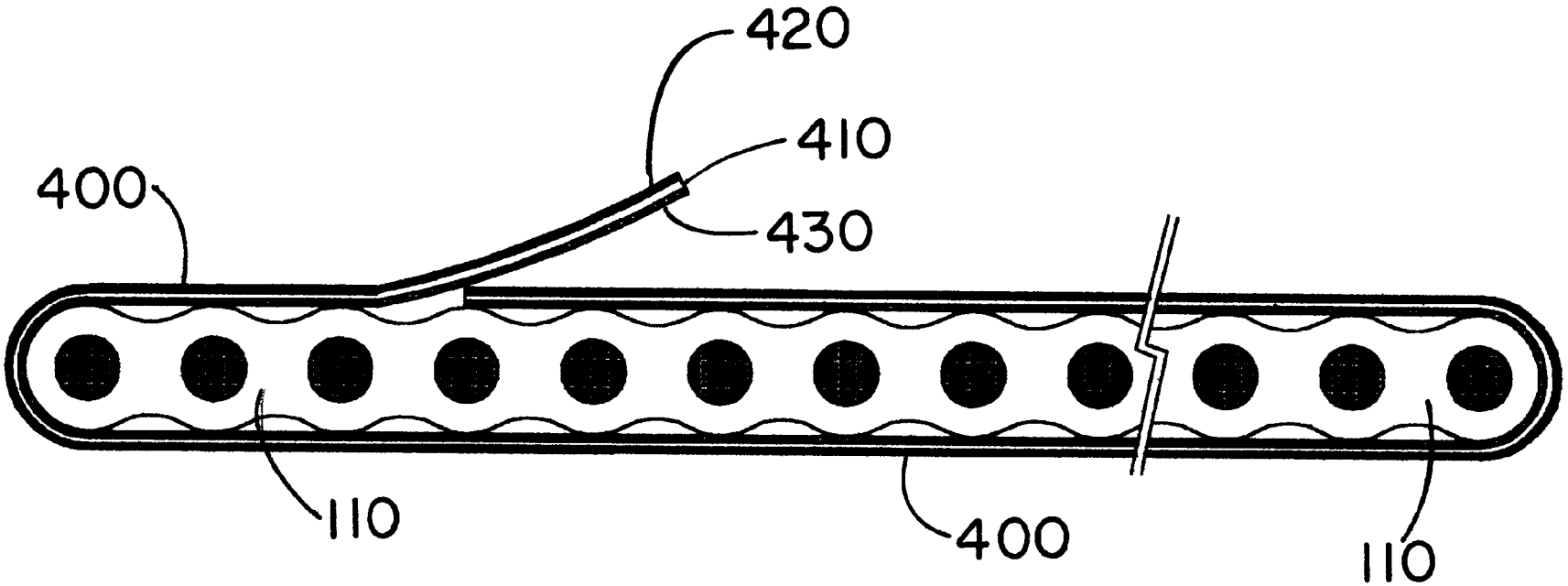
FIG. 22 illustrates an enlarged sectional view of the supported metal foil wrapped signal transfer line along line 22–22' of FIG. 16, suitable for use in connection with another example embodiment of the present invention.

In a further embodiment of the assembly 100, the first and second signal transfer lines 110 are shielded from both external and internal interference by surrounding each transfer line 110 with a supported metal foil wrapping 400. The supported metal foil wrapping 400 includes a thin metal sheet of aluminum or copper foil 410 supported by a plastic film 420, such as polyethylene or polyester. Preferably the plastic film 410 is composed of polyester known by the trademark Mylar. The wrapping 400 also contains an adhesive layer 430 to assist in holding the wrapping 400 in place when wrapped about the signal transfer line 110. FIG. 22 shows a cross sectional view of a flat ribbon cable signal transfer line 110, such as shown in FIG. 16, wrapped with the supported metal foil wrapping 400. The metal foil wrapping 400 protects against electromagnetic noise interference and eliminates external radio frequency interference (RFI), as well as signal cross talk between transfer lines 110, 195 during signal transfer through the lines 110, 195.

Alternatively, protection against electromagnetic noise interference and cross talk in signal transfer lines 110, 195 can be achieved by applying a layer of metallic paint such as copper or silver, over the whole surface of the flat ribbon cable signal transfer line 110. This alternative metallic paint interference protection is more expensive than using the supported metal foil wrapping 400, but may be required in particular applications.

Figure 15:
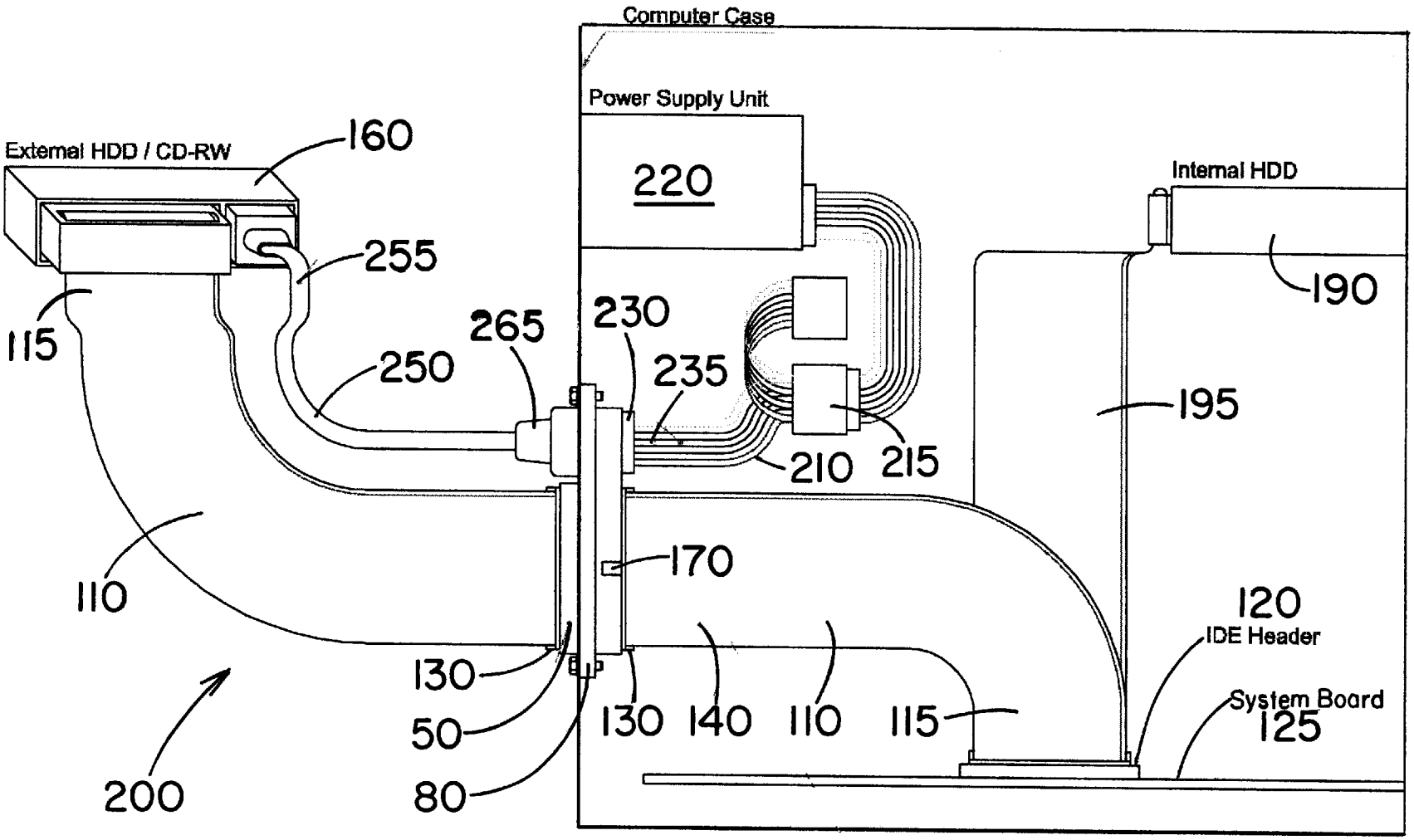
FIG. 15 illustrates another connecting assembly, suitable for use in connection with another example embodiment of the present invention.

FIG. 15 shows another embodiment of the invention, an assembly 200 for connecting a computer, having a system board with an IDE header and a hard disk drive, with an external device for powering the external device and for signal transfer. The assembly 200 includes a first signal transfer line 110 connected at a first end 115 to the computer via the IDE header 120 mounted on the system board 125 of the computer. The first signal transfer line 110 has a female connector 130 containing a set of signal transfer receptacles 135 (not shown) at a second end 140. A second signal transfer line 110, essentially the same as the first signal transfer line, is connected at a first end 115 to the powered external device 160, such as a hard disk drive. The second signal transfer line 110 has a female connector 130 containing a set of signal transfer receptacles 135 (not shown) at a second end 140. The first and second female connectors 130 each plug into an array of pin members 30 on one face of the connector member 50, described above, for coupling the first and second signal transfer lines 110 via the connector member 50, as shown in FIG. 15. Each female connector has a positioning member 170 that fits into one cutout slot 66 of the connector member 50. The connector member 50 is positioned in an aperture in a computer case, such as an I/O slot, using the bracket member 80, to simplify connection of the two signal transfer lines. It should be noted that the computer internal hard disk drive 190 is also connected to the IDE header 120 of the system board 125 via a separate signal transfer line 195. Although the signal transfer lines 110 and 195 can be of any suitable structure, preferably the signal transfer lines 110 and 195 are flat, forty-conductor ribbon cables as depicted in FIG. 15. Most preferably, the signal transfer lines 110 and 195 are flat, eighty conductor ribbon cables including forty ground conductors. The eighty conductor ribbon cables are suitable for meeting the older Ultra ATA/66 and new Ultra ATA/100 interface requirements.

In a further embodiment of the assembly 200, the first and second signal transfer lines 110 are shielded from both external and internal interference by surrounding each transfer line 110 with a supported metal foil wrapping 400, as described with respect to assembly 100 above. Again refer to FIG. 22 for details of the supported metal foil wrapping 400.

Figure 17:
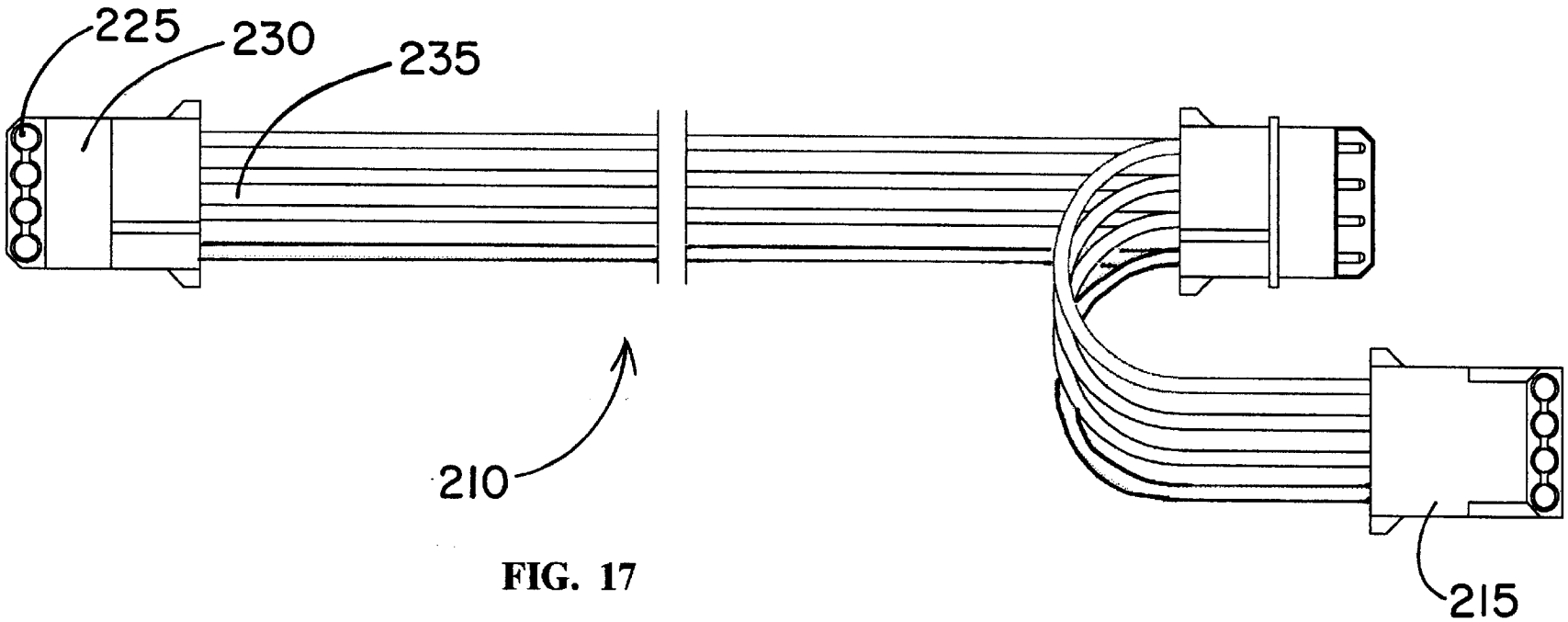
FIG. 17 illustrates a power cord, suitable for use in connection with another example embodiment of the present invention.
Figure 18:
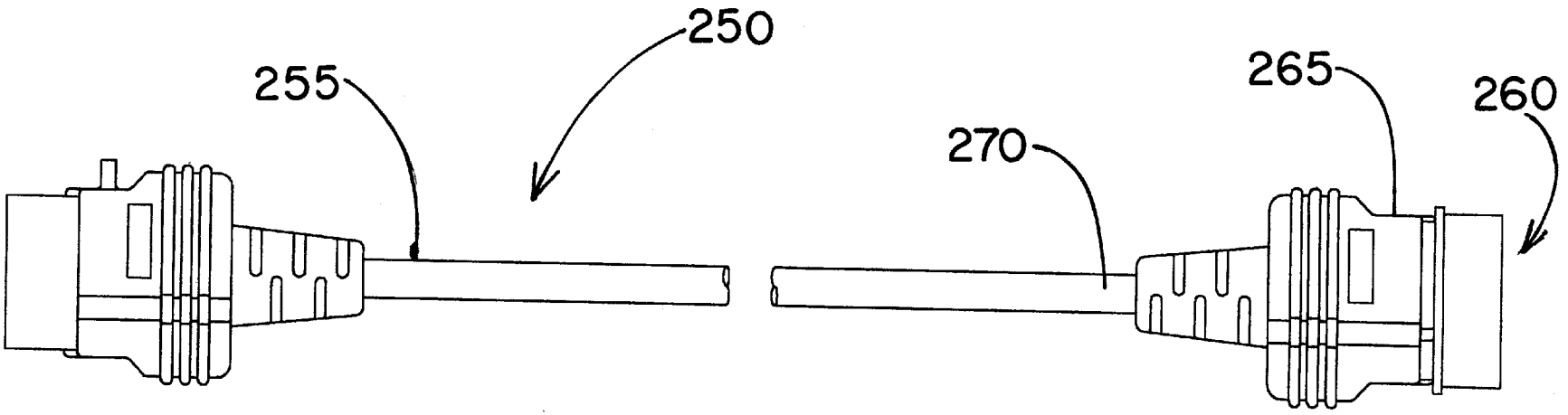
FIG. 18 illustrates another power cord, suitable for use in connection with another example embodiment of the present invention.

The assembly 200 also includes a first power cord 210 connected at a first end 215 to the computer power supply 220. The first power cord 210, shown in greater detail in FIG. 17, splices into the existing power supply line of the computer. The power cord 210 has an arrayed set of receptacles 225 in a female plug 230 at a second end 235. A second power cord 250 connects at a first end 255 to the external device, such as a hard disk drive 160, the power cord 250 having an arrayed set of pins 260 (not shown) in a male plug 265 at a second end 270. The receptacle 225 of the female plug 230 connects with the arrayed pin end 74 of pin-receptacle members 70 of the connector member 50, and the pins 260 of the male plug 265 connect with the arrayed receptacle end 72 of pin-receptacle members 70 of the connector member 50. The second power cord 250 is shown in greater detail in FIG. 18. Thus, both electrical power and signal transfer occurs between the computer and the external hard disk drive by means of connector assembly 200.

Figure 19:
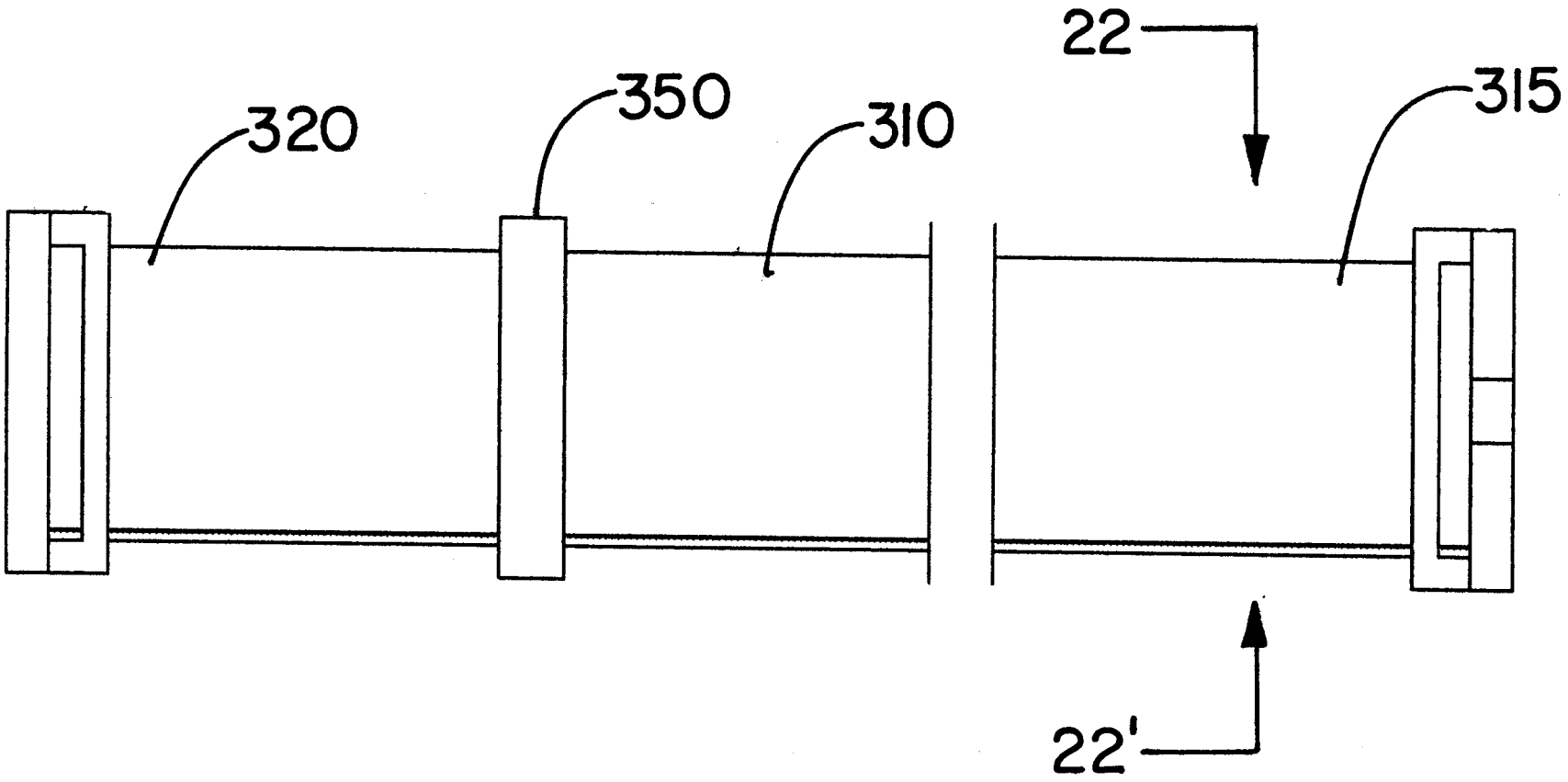
FIG. 19 illustrates a signal transfer line, suitable for use in connection with another example embodiment of the present invention.
Figure 20:
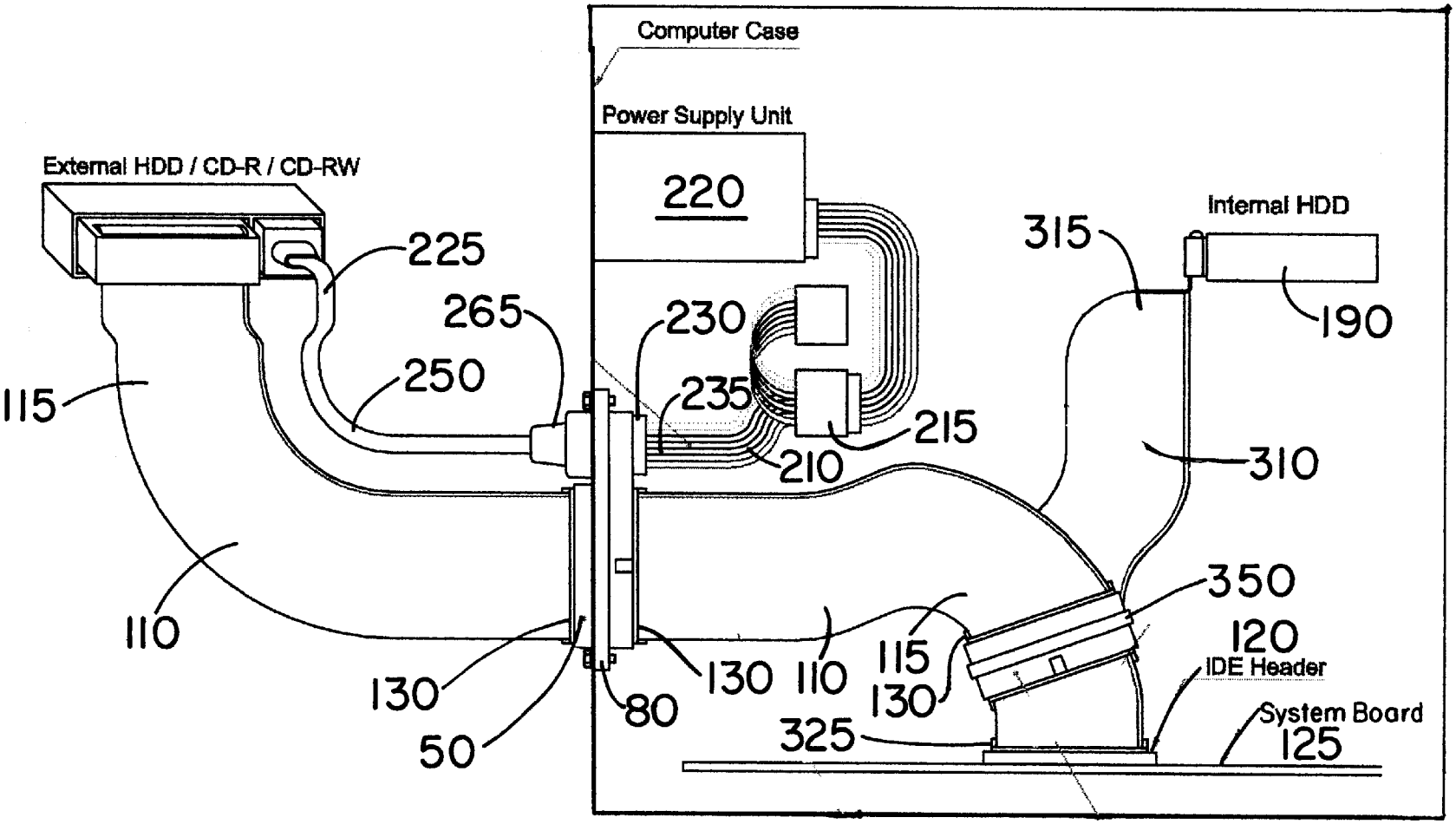
FIG. 20 illustrates another connecting assembly, suitable for use in connection with another example embodiment of the present invention.
Figure 21:
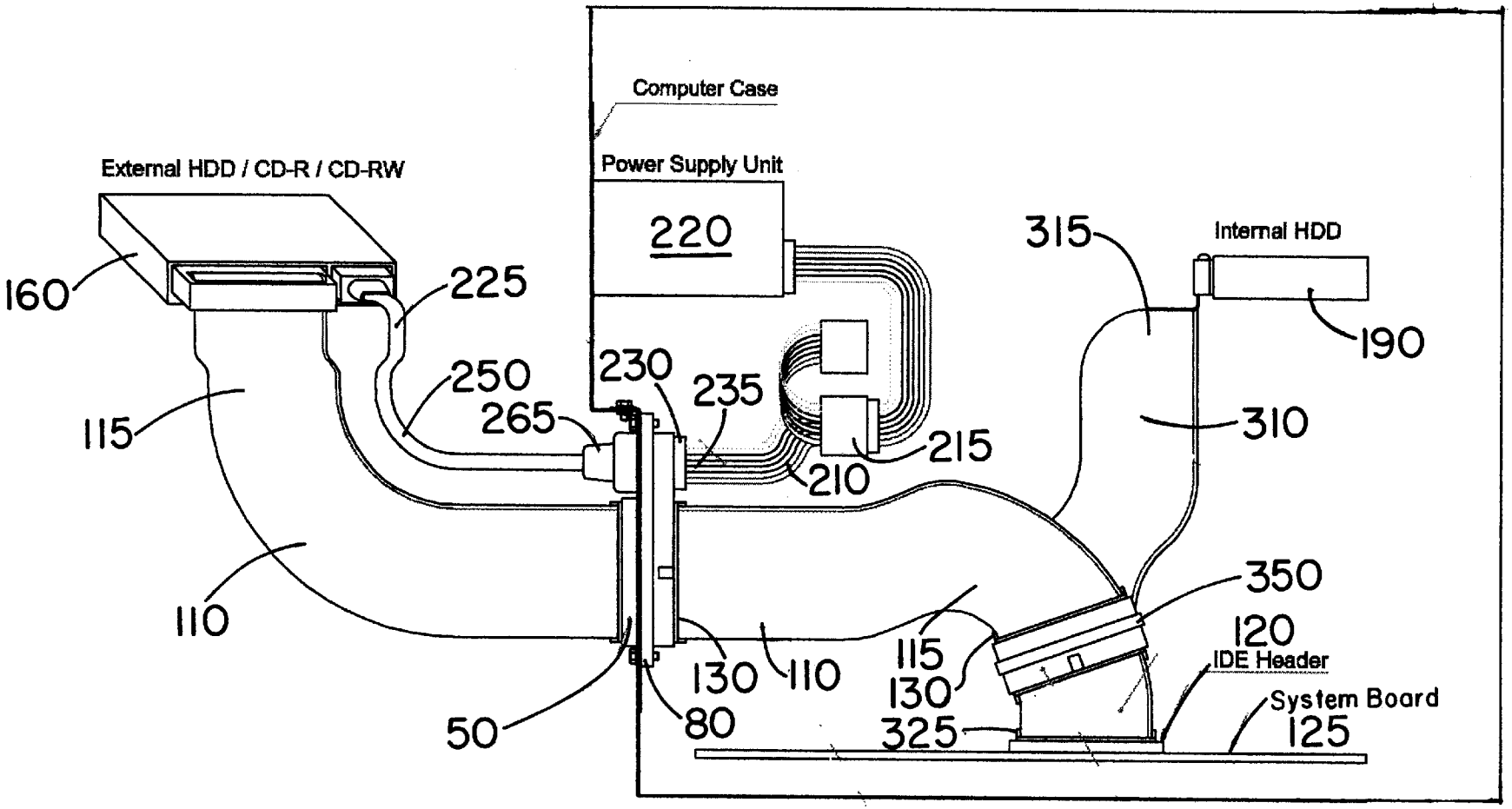
FIG. 21 illustrates another connecting assembly, suitable connection with another example embodiment of the present invention.

A further example embodiment of the invention is shown in FIG. 19 where another signal transfer line is disclosed. The signal transfer line 310 of FIG. 19 replaces the internal hard drive signal transfer line 195 between the IDE header 120 and the internal hard disk drive 190 of FIGS. 14 and 15. Signal transfer line 310 has a first end 315 for attachment to the internal hard drive 190, and a second end 320 with an WDC connector 325 for attachment to the EDE header 120 mounted on the system board 125 of the computer. The signal transfer line 310 also has an IDC dual connector 350 interposed in the signal transfer line 310 near the second end 320. As shown in FIGS. 20 and 21, the dual connector 350 positioned adjacent the signal transfer line second end 320 connects to the first end 115 of the first signal transfer line 110 previously attached to the IDE header 120. This configuration reduces the distance of signal transmission between the IDE header 120 on the system board and the external hard drive 160, thus reducing the level of signal to cross talk between signal transmission lines. In FIG. 20, the bracket member 80 holds the connecting member 50 in an aperture in the computer case. In FIG. 21, another bracket member 80, shown in more detail in FIG. 13, holds the connector member 50 in an I/O port.

In a further embodiment, the signal transfer lines 110 and 310 of FIG. 19 is shielded from both external and internal electromagnetic noise interference by surrounding the transfer lines 110 and 310 with a supported metal foil wrapping 400, as described with respect to signal transfer lines 110 above. Again refer to FIG. 22 for details of the supported metal foil wrapping 400.

Alternatively, protection against electromagnetic noise interference and cross talk in signal transfer lines 110, 310 can be achieved by applying a layer of metallic paint, such as copper or silver, over the whole surface of the flat ribbon cable signal transfer lines 110 and 310. This alternative metallic paint interference protection is more expensive than using the supported metal foil wrapping 400, but may be required in particular applications.

While the present invention has been described with reference to several particular example embodiments, those skilled in the art will recognize that many changes may be made thereto without departing from the spirit and scope of the present invention, which is set forth in the following claims.

I claim:

1. An assembly for connecting a computer, having a power supply, a system board with an IDE header and a hard disk drive, with an external device to provide power and signal transfer comprising:

a first signal transfer line connected at a first end to the computer via the IDE header mounted on the system board, the first signal transfer line having a female connector containing a set of signal transfer receptacles at a second end;

a second signal transfer line connected at a first end to the external device, the second signal transfer line having a female connector containing a set of signal transfer receptacles at a second end;

a first power cord connected at a first end to the computer power supply and having an arrayed set of receptacles in a female plug at a second end;

a second power cord connected at a first end to the external device and having an arrayed set of pins in a male plug at a second end; and a connector for coupling first and second signal transfer lines and first and second power cords comprising;

i) an elongated generally cubical body member of a first length, a first width, and a first height, the body member having first and second faces and a peripheral surface comprising discontinuously planar upper and base parts, and first and second end parts;

ii) a cutout section in each upper and base part, each cutout section opening to opposite body faces;

iii) a set of dual pin members, each with first and second ends, mounted in and extending through the body member in a width-wise direction thereof so that the first end of each pin member is arrayed for insertion into one set of signal transfer receptacles of the first signal transfer line female connector and the second end of each pin member is arrayed for insertion into another set of signal transfer receptacles of the second signal transfer line female connector; and iv) a set of open-ended pin-receptacle members mounted in and extending through the body member in a width-wise direction thereof so that each pin-receptacle member of the set is arrayed to receive through a first face of the body member a respective set of correspondingly arrayed pins of the second end of the electrical power line male plug, and each pin-receptacle of the set is arrayed to receive through a second face of the body member a respective set of correspondingly arrayed receptacles of the second end of the electrical power line female plug.

2. The assembly according to claim 1 wherein, the set of dual pin members includes forty dual pin members arrayed in two rows of twenty pin members each, the rows oriented parallel to the body member length.

3. The assembly according to claim 1 wherein, the set of open-ended pin-receptacles includes four pin-receptacle members arrayed in a row parallel the body member length and adjacent the set of dual pin members.

4. The assembly according to claim 1 wherein, the first and second signal transfer lines include forty conductor ribbon cables.

5. The assembly according to claim 1 wherein, the first and second signal transfer lines include eighty conductor ribbon cables including forty ground conductors.

6. The assembly according to claim 1 wherein, the female connectors of the first and second signal transfer lines each include a positioning member adapted to fit into one cutout section of the body member upper part and base part.

7. The assembly according to claim 1 further comprising;

a bracket member secured to the connector body member along the peripheral surfaces thereof, the bracket member adapted for securing the body member within an electrical device case aperture.

8. The assembly according to claim 1 further comprising;

a supported metal foil wrapping surrounding each of said first and second signal transfer lines to prevent both external and internal interference during signal transfer through the transfer lines.

9. The assembly according to claim 1 further comprising;

a third signal transfer line connected at a first end to the computer hard disk drive and at a second end to the IDE header mounted on the system board, the third signal transfer line having a connector adjacent the second end thereof, the connector adapted to receive the first end of the first signal transfer line for signal transfer there between.

10. The assembly according to claim 9 wherein, the third signal transfer line includes eighty conductor ribbon cables including forty ground conductors.

* * * * *